United States Patent [19]

Roy

[11] 4,204,137

[45] May 20, 1980

[54] FLUORESCENT LAMP WITH REFRACTORY METAL ELECTRODE SUPPORTS AND GLASS FLARE SEAL STRUCTURE

[75] Inventor: Ashutosh Roy, London, England

[73] Assignee: Thorn Electrical Industries Limited, London, England

[21] Appl. No.: 816,564

[22] Filed: Jul. 18, 1977

[30] Foreign Application Priority Data

Jul. 19, 1976 [GB] United Kingdom ..... 30007/76
Oct. 8, 1976 [GB] United Kingdom ..... 42004/76

[51] Int. Cl.[2] ..... H01J 61/30; H01J 61/36; H01J 61/42

[52] U.S. Cl. ..... 313/491; 313/217; 313/221; 313/493; 313/219

[58] Field of Search ..... 313/491, 493, 332, 219, 313/318, 217, 221

[56] References Cited

U.S. PATENT DOCUMENTS

| | | | |
|---|---|---|---|
| 2,000,395 | 5/1935 | Jones | 313/217 X |
| 2,479,164 | 8/1949 | Inman | 313/217 X |
| 2,945,977 | 7/1960 | Schönherr | 313/493 X |
| 2,961,566 | 11/1960 | Waymouth et al. | 313/486 X |
| 3,069,580 | 12/1962 | Waymouth, Jr. | 313/491 |
| 3,249,788 | 5/1966 | Wainio et al. | 313/491 |
| 4,013,914 | 3/1977 | Clune et al. | 313/313 |

OTHER PUBLICATIONS

"Materials and Techniques for Electron Tubes" by Walter H. Kohl, 1966, Chap. 2, Ceramics, pp. 103, 108.

*Primary Examiner*—Palmer C. Demeo
*Attorney, Agent, or Firm*—Robert F. O'Connell

[57] ABSTRACT

The invention relates to electrode mount assemblies for electric discharge and fluorescent lamps. In accordance with the first aspect of the invention the portions of the electrode support wires which are exposed to electron bombardment within the body of the lamp have at least their surface formed of refractory material. The exposed portions may be coated with a refractory material such as boron nitride or made wholly of a refractory metal such as molybdenum. According to a second aspect of the invention relatively cheap soda-lime silicate glass can be used for the end flares of the lamp tubes, because the provision of refractory surfaces on the vulnerable portions of the support wires enables a metal to be chosen for the portions of the wires passing through the glass seal which closely matches the glass in thermal expansion coefficient. The invention improves the life of lamps by reducing end blackening, reduces the incidence of cracks in the punch seal or neck regions of the lamp and may enable cheaper materials to be used for various structural items.

6 Claims, 8 Drawing Figures

Figure 1:
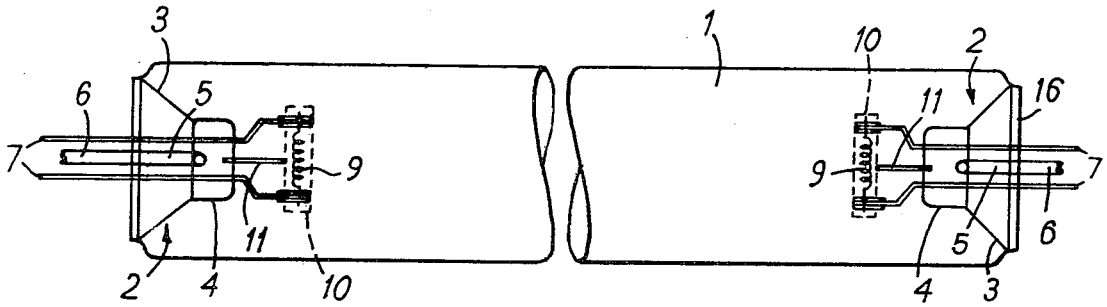

FLUORESCENT LAMP WITH REFRACTORY METAL ELECTRODE SUPPORTS AND GLASS FLARE SEAL STRUCTURE

The present invention relates to electrical discharge lamps and more especially to mount assemblies for fluorescent lamps.

In electrical discharge lamps of the fluorescent type it is usual for the electrodes to consist of tungsten coils bearing electron-emissive material, each coil being clamped to and carried between two metal supports or leadwires embedded in a "pinch" seal in a respective glass flare which is sealed into one end of the lamp tube. In order to obtain a reliable seal it is customary to use composite "Dumet" support elements and lead glass mounts. p In a lamp running in an alternating current circuit each electrode acts as positive and negative electrode alternately. During the positive part of the cycle the electrode, being bombarded by electrons, gets overheated and in the past this has led to evaporation of the support wires, causing blackening of the inner surfaces of the lamp tube. The present invention is particularly concerned with reducing or preventing evaporation of the support wires and of so-called "end blackening," and with facilitating the formation of reliable glass-metal seals in leadwire or mount assemblies.

According to this invention a discharge or fluorescent lamp has a mount assembly in which the portions of the support wires which are exposed to electron bombardment within the body of the lamp have at least their surface formed of refractory material.

Preferably, this is achieved by coating the surface of the exposed portions of the support wires with refractory material, or by forming the exposed portions of the support wires entirely of refractory metal.

The invention gives more flexibility in the choice of materials for at least those parts of the support wires located in the region of the seal, which in turn enables a cheaper glass to be employed for the flares. Thus soda-lime glass can be used in conjunction with wires, for example of nickel-iron alloy, which closely match the glass in coefficient of thermal expansion. Expensive "Dumet" components used in the prior art can be avoided, while the soda-lime glass flares can be butt-sealed to the ends of the lamp tube instead of the conventional drop-seal, which requires the use of lead glass.

Refractory material which is used to coat the surfaces of support wires in accordance with the invention preferably has lubricant properties so as to prevent its damaging, by abrasion, machinery used in the assembly of the lamp.

Advantageously, where a portion of a support wire is composed of refractory metal this portion is welded to the other portion of the wire, which may itself comprise more than one length of wire welded together and may include a metal which facilitates the formation of the required glass-metal seal.

The use of soda-lime silicate glass for the flares in electrode assemblies in fluorescent lamps represents in itself a second important aspect of the invention.

Although soda-lime silicate glass has been generally used for making the glass tubes for fluorescent lamps, the flares have been made from lead glass despite the fact that it is more expensive than soda-lime glass and that differences in coefficient of expansion between lead glass and soda-lime glass frequently cause "neck cracks" where the flare is sealed to the tube. It was thought that serious problems would arise from mismatch between metal and glass, and that electrolysis between the leadwires and soda-lime glass would destroy the seal between the wires and the glass and cause air leaks.

Moreover, it has previously been found that oxide formed on the surface of conventional leadwire materials as they are being sealed into the flare results in a poor metal/glass seal. For this reason "Dumet" wires, which have a surface on which oxide does not readily form during the sealing operation, have been used for at least that portion of the leadwire passing through the flare, while if a portion of a refractory inner support wire is embedded in the glass pinch and welded to Dumet, this often gives rise to "pinch cracks" in the flare due to differences between the coefficient of expansion of the glass and the refractory wire.

According to this aspect of the present invention a mount assembly for a fluorescent lamp comprises a flare made of soda-lime glass and leadwires of which at least the portions passing through the glass have a coefficient of thermal expansion matching that of the glass over most of the temperature range from room temperature to the sealing temperature at which the leadwires are sealed into the flare.

The leadwires are preferably made from the nickel-iron alloy referred to above and advantageously have an adherent oxide layer formed on the surface which is sealed into the glass of the flare.

Figure 2:
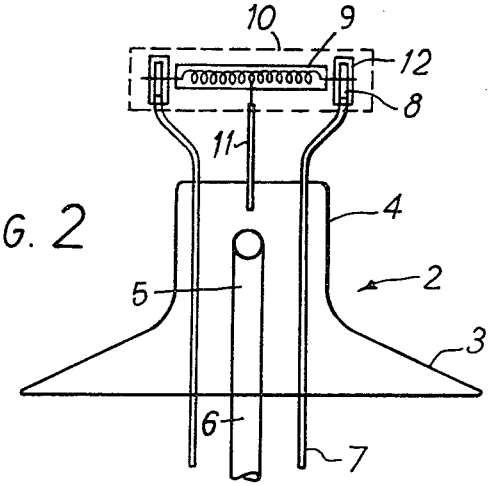
Figure 3:
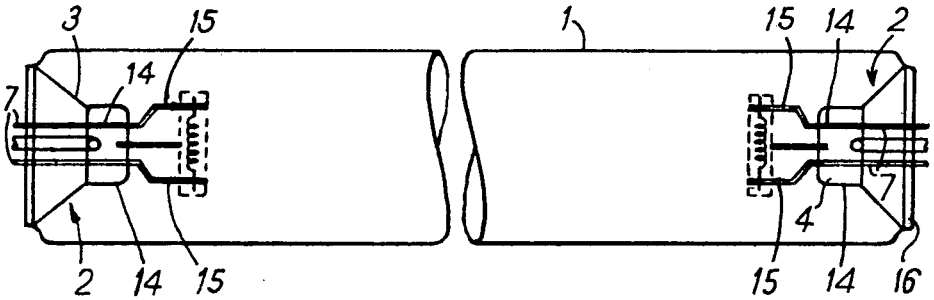
Figure 4:
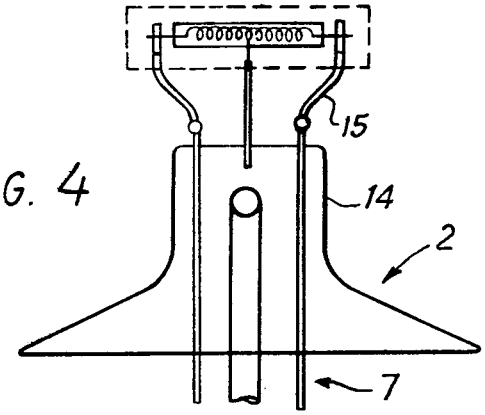

The present invention will now be described, by way of example, with the aid of the accompanying drawings in which:

FIG. 1 is a diagrammatic view of a fluorescent lamp in accordance with one embodiment of the present invention, FIG. 2 shows one mount assembly for the lamp of FIG. 1 on an enlarged scale, FIG. 3 shows a fluorescent lamp embodying a second example of the invention, FIG. 4 shows one mount assembly for the lamp of FIG. 3 on an enlarged scale, and FIGS. 5, 6, 7 and 8 are partial views of flares bearing four examples of leadwires suitable for use in connection with the second aspect of the invention.

The fluorescent lamp shown in FIG. 1 has a glass tube 1 into each end of which is sealed a glass flare 2.

The glass flares (see FIG. 2) are circular in section and have a tapered portion 3 which at its smaller end is integral and coaxial with a parallel sided portion 4 where the pinch seal is formed, and the flares are sealed, at the larger end of the tapered portion 3, into the ends of the glass tube 1.

Either one or both (as shown in FIG. 1) of the flares 2 may have an axial bore 5 which extends from the outer end or ends of the flare or flares as a tubulation 6, through which the lamp may be exhausted and the mercury and the required gas or gas mixture introduced before the bore or bores 5 are closed at their inner end or ends, thereby completely sealing the lamp.

Passing through and sealed into each glass flare 2 is a pair of support wires or leadwires 7 which extend generally parallel to the flare axis and project from the inner end of the flare. At the inner end of each leadwire is an inner support clamp portion 8, and an electrode in the form of a coated coil 9 is held between the clamps 8, the coil being substantially perpendicular to the axis of the lamp.

The coil 9 is surrounded by a floating shield 10 held in place by a support 11 which is itself attached to the glass flare 2.

The inner support clamps 8 and parts of the leadwires 7 which are subject to electron bombardment when the lamp is in use have a coating 12 (FIG. 2) of boron nitride, a refractory material which also possesses lubricant properties. The boron nitride may be applied by any suitable method, most conveniently in the form of a suspension in water or organic solvent applied to the leadwire by such means as spoon dipping, brushing, spraying or drip feeding through a jet.

According to a second example of the present invention, a fluorescent lamp is shown in FIG. 3 having a glass tube 1 and glass flares 2 (FIG. 4), similar to those in FIGS. 1 and 2, and into which are sealed support wires or leadwires 7.

Each leadwire 7 has a portion 14 extending through the flare 2 and into the space within the lamp, and a portion 15 of refractory metal welded to the inner end of the portion 14. The refractory metal portion 15 may extend any distance along the leadwire 7 from the support clamp 8 up to a point in the leadwire 7 immediately adjacent, but not in contact with, the glass of the flare 2. Thus it is ensured that the portion 15 of the leadwire 7 that is subject to electron bombardment when the lamp is in operation is composed of wire formed from refractory metal. The preferred refractory metals for this purpose are high temperature molybdenum, tantalum, titanium, vanadium and niobium.

The remaining portion 14 of the leadwire may be made from a nickel-iron alloy having a coefficient of expansion matched with that of the glass flare 2, which can be of soda-lime glass and may be butt sealed into the end of the tube 1.

Fluorescent lamps as shown in FIGS. 1 and 2 which embody the second important aspect of the invention have a soda-lime glass tube 1 into the end of which a soda-lime glass flare 2 is butt-sealed at the so-called "neck" 16. The exhaust tubulation 6 is also formed of soda-lime glass.

It is in the neck region 16 of conventional tubes that occasional cracks develop owing to thermal expansion mismatch between the lead glass flare and the soda-lime glass tube and these are eliminated by the use of soda-lime glass for the flare. Chemical reduction of the lead glass during sealing often produces a dark seal in the region 3 and makes quality control inspection difficult, and again this is avoided or reduced by the use of soda-lime glass at this point.

In FIGS. 5, 6, 7 and 8 the leadwires 7 consist respectively of one, two, three and four lengths of wire welded where necessary at points indicated generally by the numeral 17.

Figure 5:
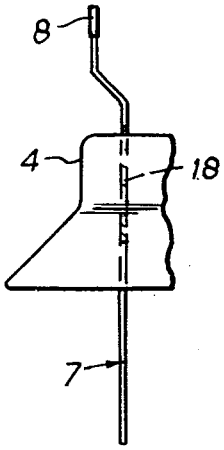

The leadwire shown in FIG. 5 is of nickel-iron alloy having a coefficient of expansion closely matching that of the soda-lime glass of the flare, so as to eliminate or reduce the possibility of pinch cracks forming in the portion 4 of the flare, and the length of the leadwire has a uniform adherent surface coating of oxide, formed during fabrication of the electrode mount, which partially dissolves in the glass when the leadwires are sealed into the flare and thereby improves the seal. Sufficient oxide should be present to prevent complete solution in the glass, as this may give a weaker seal. The clamp portion 8 may have a refractory coating of boron nitride as already described above.

Figure 6:
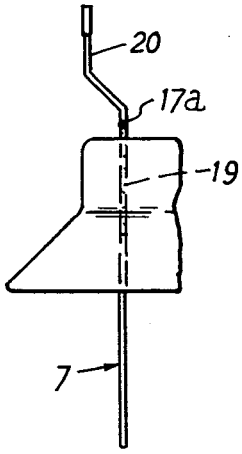

FIG. 6 shows a two-part leadwire, welded at 17*a*, of which the portion 19 passing through the flare is made of nickel-iron alloy and has an adherent oxide coating extending over that portion of the leadwire passing through the pinch region of the flare. The portion 20 of the leadwire forming the inner support wire may be made of refractory metal, or of any other suitable metal with or without a boron nitride coating.

Figure 7:
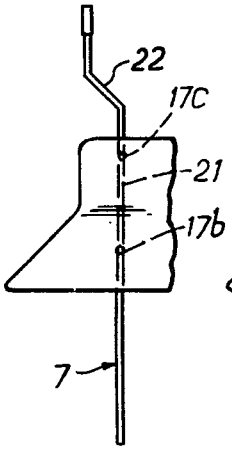

FIG. 7 shows a three-part leadwire welded at 17*b* and 17*c* in which the portion 21 sealed into the pinch section of the flare is made of Dumet, and the portion 22 making up the inner support part of the leadwire is of nickel-iron alloy, with or without a boron nitride coating on the clamp.

Figure 8:
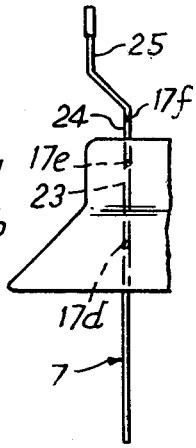

FIG. 8 shows a four-part leadwire welded at 17*d*, 17*e* and 17*f*, of which the portion 23 between the welds 17*d* and 17*e* and sealed into the pinch portion of the flare is made from Dumet while the portion 24 between the welds 17*e* and 17*f* is made from nickel-iron alloy and connects the length of Dumet with the inner support wire 25 of refractory metal or other suitable metal, with or without a boron nitride coating on the clamp. It is necessary to include the nickel-iron portion 24 because, unlike refractory metal, it has a coefficient of expansion which matches that of the soda-lime glass of the flare sufficiently well to form a seal without an undue risk of the occurrence of pinch cracks.

Nickel-iron alloys, for example as sold under the trade marks NILO 475, 48 and 51, may be prepared for sealing by pickling in dilute hydrofluoric or hydrochloric acid and nitric acid, followed by rinsing. The metal should then be decarbonized in a wet hydrogen atmosphere at 900–1100° C. for about one hour and oxidized immediately before sealing into the glass. The wires may be oxidized by heating to 600–1050° C. in a sulphur-free atmosphere, the time and temperature being chosen to form an oxide film sufficiently thick to have the appearance of a brownish-grey discoloration after sealing.

I claim:

1. In a fluorescent discharge lamp comprising a tubular light transmitting envelope having a fluorescent coating on the interior wall thereof, coil electrodes at opposite ends therein, support wires connected to said coil electrodes passing through respective end walls of said envelope and sealed therethrough, and a fill comprising gas and mercury, an improved electrode support assembly comprising:

a glass flare adapted to be sealed in said envelope to form an end wall thereof, said flare being composed of soda-lime glass;

said support wires having first portions sealed in said glass flare and comprising a metal alloy having a coefficient of thermal expansion matching that of said soda-lime glass; and second portions which are disposed outside said glass flare and in operation of the lamp are exposed to electron bombardment, said second portions being welded to said first portions and comprising a refractory metal.

2. The lamp of claim 1 wherein said first portions are formed of nickel-iron alloy.

3. The lamp of claim 1 wherein said exposed portions of said support wires are coated with an adherent coating of boron nitride refractory material.

4. In a fluorescent discharge lamp comprising a tubular light-transmitting envelope having a fluorescent coating on the interior thereof and a glass flare seal region forming at least one end wall thereof, coil electrodes therein, and support wires connected to said coil electrodes, the improvement wherein said support wires comprise first portions thereof positioned within said envelope external to said glass flare seal region and exposed to electron bombardment, said first portions being formed entirely of refractory metal; and second portions thereof welded to said first portions and at least partly embedded in said glass flare seal region, said second portions being formed of a metal matching said glass flare seal region in coefficient of thermal expansion.

5. The lamp of claim 4 wherein said second portions extend outwardly through opposite surfaces of said glass flare seal region.

6. The lamp of claim 14 wherein said glass flare seal region is formed of soda-lime glass and said second portions are formed of nickel-iron alloy.

* * * * *